US005142293A

United States Patent [19]

Ross

[11] Patent Number: 5,142,293

[45] Date of Patent: Aug. 25, 1992

[54] SKYLIGHT ROOF MOUNT FOR SATELLITE ANTENNAS

[75] Inventor: David J. Ross, Leesburg, Va.

[73] Assignee: Radiation Systems, Inc., Sterling, Va.

[21] Appl. No.: 751,532

[22] Filed: Aug. 29, 1991

[51] Int. Cl.[5] ..... H01Q 19/12

[52] U.S. Cl. ..... 343/840; 343/878

[58] Field of Search ..... 343/840, 878, 880, 881, 343/882, DIG. 2

[56] References Cited

U.S. PATENT DOCUMENTS

| | | | |
|---|---|---|---|
| 3,094,303 | 6/1963 | Belger | 248/40 |
| 4,649,675 | 3/1987 | Moldovan et al. | 52/27 |
| 4,723,128 | 2/1988 | Gasque | 343/880 |
| 4,783,662 | 11/1988 | Wirth et al. | 343/757 |
| 4,799,642 | 1/1989 | Wright | 248/516 |
| 4,922,264 | 5/1990 | Fitzgerald et al. | 343/878 |

OTHER PUBLICATIONS

Test Report (Westinghouse) of Tridom NPR & Prodelin BR M6 Antenna Base Assemblies; Jan. 1990.

Brochure, Baird Satellite Supporting Systems, Aug. 1988.

Instruction Manual, VideoStar Connections, Inc. "Cushioned Roof Mount" Apr. 1989.

*Primary Examiner*—John D. Lee
*Assistant Examiner*—Robert E. Wise
*Attorney, Agent, or Firm*—Pollock, VandeSande and Priddy

[57] ABSTRACT

A satellite antenna assembly includes a nonpenetrating roof mount having a pair of rectangular ballast trays for respective placement on portions of a pitched roof forward and rearward of the crown of the roof. A hinge structure interconnects the ballast trays and overlies the crown of the roof. The ballast on the trays is concealed by covers that simulate a skylight. A satellite antenna is mounted, at one of the four corners of the ballast tray located on the rear portion of the pitched roof, on a simplified antenna support and adjustment structure that facilitates variation of the polar orientation and elevation of the antenna.

18 Claims, 4 Drawing Sheets

SKYLIGHT ROOF MOUNT FOR SATELLITE ANTENNAS

BACKGROUND OF THE INVENTION

The present invention relates to a satellite antenna assembly that includes a nonpenetrating roof mount adapted to be placed on a residential pitched roof, and is more particularly concerned with such an assembly having a simpler and less expensive arrangement for supporting and adjusting the polar and elevational orientation of the antenna, and which has an overall aspect that is more aesthetically pleasing than roof mounted antenna arrangements suggested heretofore.

It has been conventional to mount satellite antennas on the roof of a residence or other building by use of a tripod structure which penetrates the roof. Such penetrating roof mounts create a risk of water leakage, a potential for wind damage, and are expensive to install. In an effort to avoid some of these problems nonpenetrating roof mounts have been suggested that rely upon the weight of concrete ballast to keep an antenna platform in place on a flat or pitched roof. The antenna is normally supported on a pipe or mast located in the center of the mount, and adjustable tie rods and/or actuators are provided for pointing the antenna in a desired direction. The overall arrangement of these prior nonpenetrating roof mount assemblies has accordingly been comparatively complex and costly.

Prior satellite antenna assemblies employing nonpenetrating roof mounts have also been unsightly since the ballast employed to keep the mount in place is not hidden and since, moreover, when mounted on a pitched roof, the antenna has typically been located at an elevated position at and above the crown of the roof, making the antenna highly visible from both the front and back of a residence.

The present invention is intended to obviate all of the foregoing disadvantages through the provision of an antenna assembly and nonpenetrating roof mount that is simpler in configuration and more aesthetically pleasing than arrangements suggested heretofore.

SUMMARY OF THE INVENTION

In accordance with the present invention, a nonpenetrating roof mount comprises a pair of trays that are adapted to support ballast taking the form of, e.g., concrete blocks, or sand or liquid held in one or more closed containers or tanks. The ballast trays, containers and/or tanks are hingedly connected to one another for placement over the crown of a pitched roof at an angle that corresponds to the roof angle. Ballast covers simulating skylights are provided on both the rearward and forward ballast trays to conceal the ballast. The term "covers" as used herein, and in the appended claims, includes containers or tanks (for granular or liquid ballast) which are configured to simulate skylights.

A satellite antenna is supported on a "C" cross section channel mast located at one of the four corners of the rearward ballast tray so that the antenna cannot be seen from the front of the pitched roof. The antenna is mounted to the C-channel support by means of "U" bolts which clamp a tubular antenna back support to the channel support, and which lock it in place after pointing of the antenna. The reflector back structure, in addition to being used as a pivot for adjusting the antenna onto a designated satellite, also acts as the feed support; the overall number of parts required for assembly, and hence the overall cost of the assembly, is therefore significantly reduced.

The capability of mounting the antenna support on any corner of a ballast tray located on the rear portion of a pitched roof, behind and below the crown of the roof, enables an installer to properly orient the antenna during a pointing operation without the antenna being visible from the front of the roof. This feature of the invention, together with the concealment of the ballast by covers that simulate skylights, makes the overall arrangement more aesthetically pleasing than has been the case with other roof mounted antenna support arrangements suggested in the past.

BRIEF DESCRIPTION OF THE DRAWINGS

The foregoing objects, advantages, construction and operation of the present invention will become more readily apparent from the following description and accompanying drawings wherein.

DESCRIPTION OF THE PREFERRED EMBODIMENTS

Figure 1:
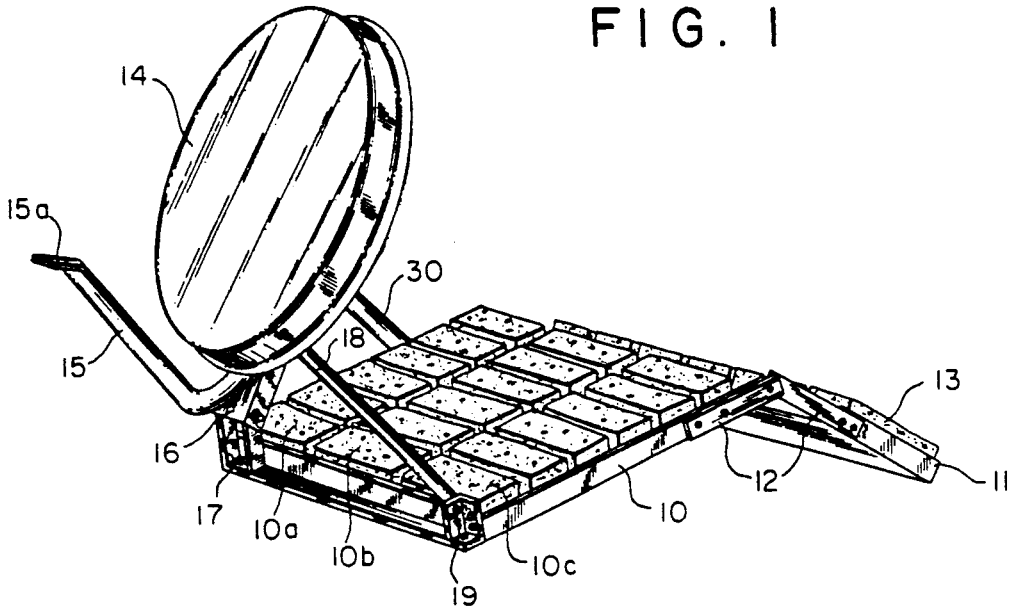
FIG. 1 illustrates the general configuration of a satellite antenna assembly constructed in accordance with the present invention.

Referring initially to FIG. 1, a nonpenetrating roof mount constructed in accordance with the present invention comprises a pair of ballast trays or supports 10 and 11 that are adapted to be placed respectively on the rear and forward surfaces of a pitched residential roof, optionally upon friction pads located below the ballast trays. The two ballast trays are hingedly interconnected to one another by a hinge assembly 12 which overlies the crown of the roof. In the particular arrangement shown in FIG. 1, the tray 10 supports three rows 10*a*, 10*b*, and 10*c* of ballast comprising, for example, 4"×8"×16" concrete blocks that load the roof at 33 pounds per square foot, this being a typical live load design requirement for most residential construction. Alternatively, the ballast can comprise a liquid, e.g., an anti-freeze and/or water, held within a closed tank, or a granular material, e.g., sand, disposed in an appropriate container, or combinations of such ballast with one another and/or with concrete blocks.

The tray 11 disposed on the forward surface of the pitched roof may have a configuration which is the same as or different from the configuration of ballast tray 10 as will be discussed hereinafter, and also supports ballast 13 thereon. In the particular arrangement shown in FIG. 1, the ballast on each tray extends to the crown of the roof, but in a preferred embodiment of the invention the arrangement is such (as better shown for example in FIGS. 3 and 7) that the trays, supports, containers and/or tanks and the ballast supported thereon or therein are each below and spaced from the crown of the roof. The ballast on the forward and rearward trays is, moreover, concealed by plastic caps (not shown in FIG. 1 but shaped, e.g., as shown in FIG. 6) that simulate skylights, or held in tanks or containers that are shaped to simulate skylights.

A satellite antenna consisting generally of a metallic reflector 14 configured as a section of a paraboloid, and associated with a L-shaped unitary support structure 15 adapted to receive a feed horn at the free end 15*a* of one of the legs thereof, is mounted at one of the corners of the rearward tray 10 on a C-shaped channel 16 that is pivotally attached at its lower end to a support bracket 17. The assembly further includes a brace 18 that is pivotally attached, as at 19, to another corner of ballast tray 10, and an adjustable actuator 30 that can be used to vary the elevation of the antenna.

Figure 2:
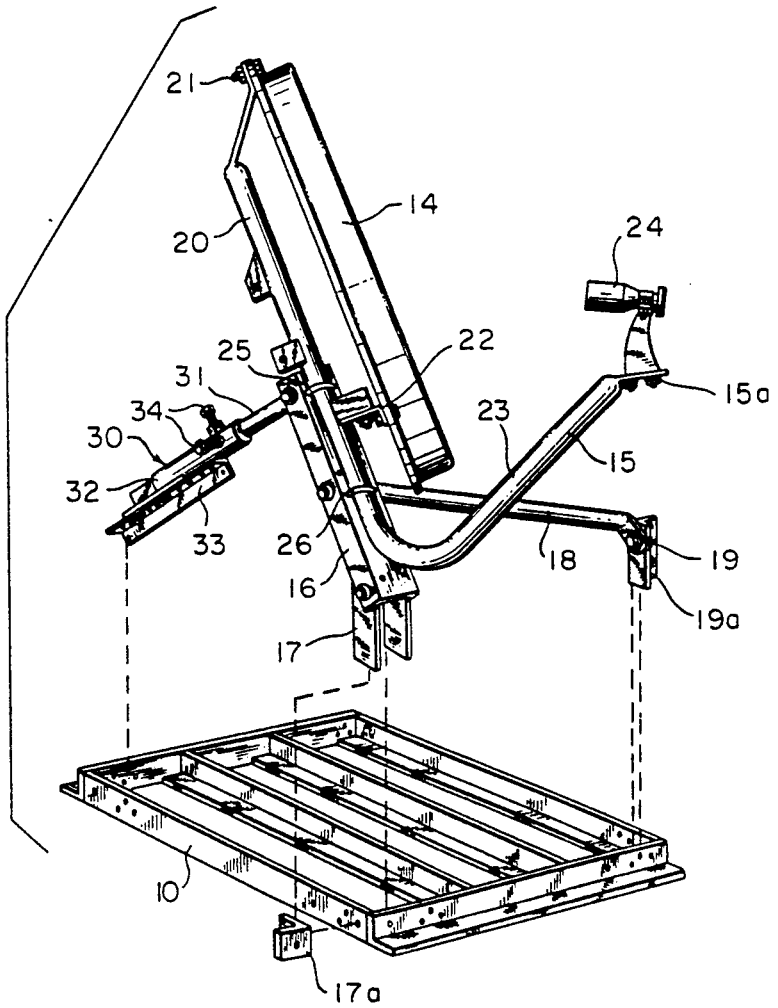
FIG. 2 is a perspective exploded view of an antenna assembly constructed in accordance with a first embodiment of the invention.

One possible configuration of the foregoing components is better illustrated in FIG. 2. As shown therein the L-shaped structure 15 is tubular in configuration, and includes an antenna back support leg 20 that is bolted at 21 to the top of antenna reflector 14, and attached at a cross beam 22 to a lower rear portion of reflector 14. The support structure 15 also includes a second leg 23 acting as a feed boom upon which a feed horn or antenna feed unit 24 can be mounted in facing relation to the forward surface of reflector 14.

Leg 20 is secured to C-channel 16 by a pair of U-bolts 25, 26 that embrace tubular leg 20, and pass through the base of C-channel 16. The free ends (not shown) of U-bolts 25, 26 are located between the sides of C-channel 16, are threaded, and receive nuts that can be loosened to permit leg 20, reflector 14, feed boom 23 and feed horn 24 to be pivoted as a unit relative to C-channel 16 about the axis of leg 20 to effect polar adjustment of the antenna, whereafter said nuts can be tightened to lock the antenna into its adjusted position relative to C-channel 16.

Elevational adjustments of the antenna are effected by the aforementioned actuator 30 which takes the form of a two section telescopic rod having a forward portion 31 that is pivotally attached to one of the side flanges of C-channel 16, and a rear portion 32 that is pivotally attached to one of the sides of the steel frame comprising ballast tray 10. The rear portion 32 of actuator 30 is bolted to an elongated member 33 which is in turn pivotally attached to the side of ballast tray 10, to extend the range of actuator 30. A plurality of longitudinally spaced bolt holes are included in member 33 different selected ones of which can be used to attach member 33 to actuator 30 to provide, in effect, a coarse adjustment of antenna elevation. Fine adjustment of antenna elevation is effected by displacement of actuator sections 31 and 32 relative to one another, whereafter they are locked into their adjusted position by means of set screws 34.

The lower end of C-channel 16 is pivotally attached to tray 10 by means of bracket or swivel channel 17 and an associated tray clip 17*a* that cooperate with one another to space the lower end of C-channel 16 above the upper surface of tray 10. Similarly, brace 18 is pivotally attached at 19 to tray 10 by means of a further bracket 19*a* that locates pivot 19 above the upper surface of tray 10. Elements 17 and 19 are sufficiently long so that, at the extreme elevation adjustment, i.e., when C-channel 16 and the antenna assembly supported thereon are pivoted to their closest possible position relative to the upper surface of tray 10, the antenna will still clear the ballast and skylight simulating covers, i.e., caps, tanks or containers supported by tray 10.

As illustrated in FIG. 2, ballast tray 10 is of rectangular configuration, and comprises a metallic outer frame which is subdivided by interior beams into three elongated rectangular sections that receive and support the rows of ballast 10*a*–10*c* (FIG. 1) or tanks or containers for ballast as described previously. The tray 10 together with the ballast supported thereon can be used alone, i.e., without being hingedly attached to a further tray as shown in FIG. 1, to provide a nonpenetrating flat roof mount for a satellite antenna assembly of the type described.

Figure 3:
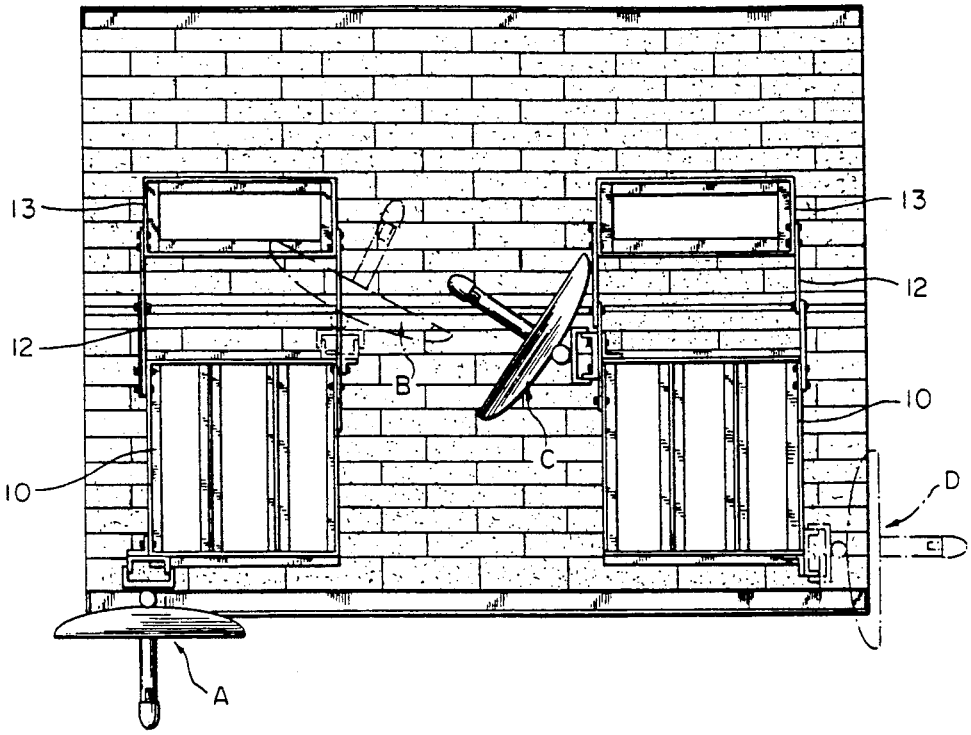
FIG. 3 is a top view of a residential pitched roof having a pair of antenna assemblies and associated nonpenetrating roof mounts thereon.

The four sides of the rectangular outer frame of tray 10 are provided with bolt holes or other mounting structures adjacent all four corners of the frame so that the C-channel 16 can be pivotally mounted at any of the four corners of the frame with the actuator rod 30 and brace 18 then being pivotally attached to appropriate other corners of the frame. This is done so that, even though the antenna support and adjustment structure shown in FIG. 2 has a limited range of polar and elevational adjustment, the antenna can nevertheless be appropriately adjusted onto its designated satellite. This aspect of the invention is diagrammatically depicted in FIG. 3 which illustrates two nonpenetrating roof mount assemblies of the type described above, consisting in each case of ballast trays 10 and 13 disposed respectively on the rearward and forward portions of a pitched roof, and hinge assemblies 12 overlying the crown of the roof. The antenna assembly A is disposed at a corner of an associated tray 10 that corresponds to the arrangement shown in FIG. 2. Alternatively, however, the antenna assembly can be mounted at any of the other corners of tray 10 as depicted at B, C, and D. Each of these mounting positions orients the antenna in a different direction as depicted in FIG. 3. Accordingly, even though an antenna, once mounted at a given corner of the tray 10, has a limited pointing range, the antenna can nevertheless be pointed toward a designated satellite by mounting the antenna at an appropriate one of the four corners of ballast tray 10.

Figure 7:
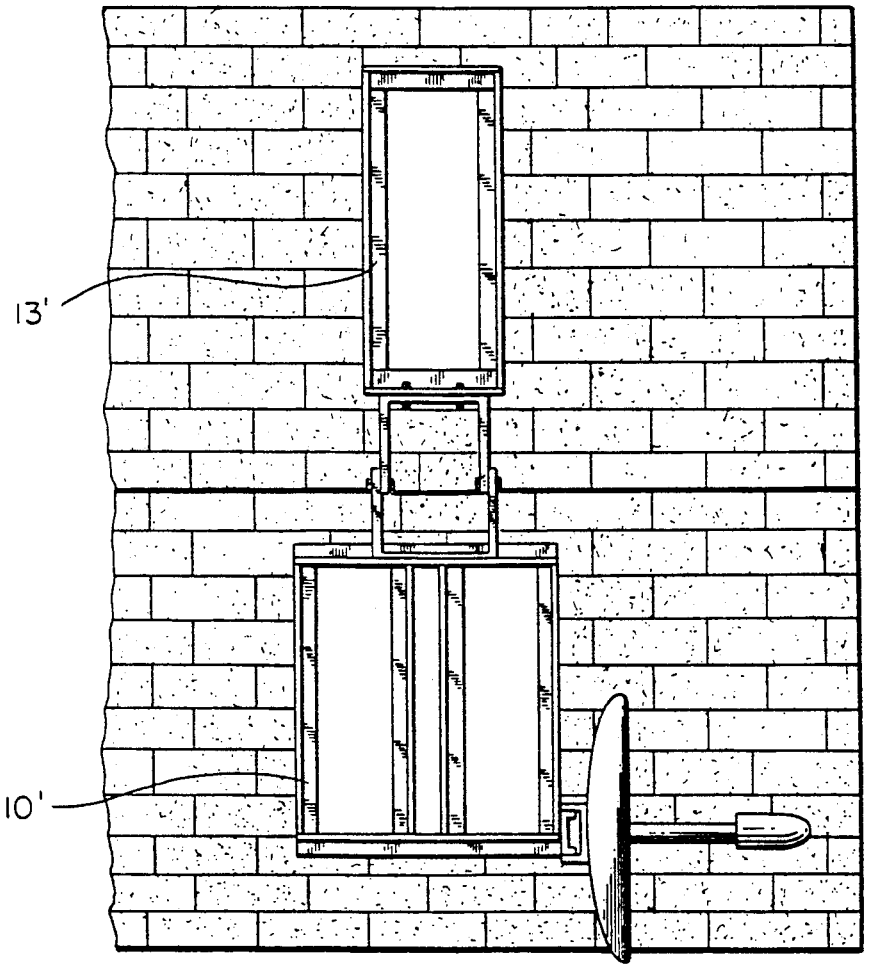
FIG. 7 is a top view of a residential pitched roof having a still further embodiment of the invention thereon.

FIG. 3 depicts another aspect of the invention, i.e., the sizes and shapes of the hingedly connected trays 10 and 13 need not be the same. Each tray 10 in FIG. 3 comprises three elongated rectangular sections of the types described in reference to FIGS. 1 and 2, but each tray 13 constitutes only a single elongated rectangular section having a size that corresponds to one of the three sections in the associated tray 10, with the direction of elongation of rectangular tray 13 being transverse to the direction of elongation of the rectangular sections in tray 10. A further possible variation is shown in FIG. 7 wherein the tray 10' disposed on the rearward portion of a pitched residential roof has only two rectangular sections, and tray 13' placed on the forward section of the pitched roof has a single rectangular section that is of the same size as the individual sections in tray 10', and oriented in a direction parallel to the sections of tray 10'.

Figure 4:
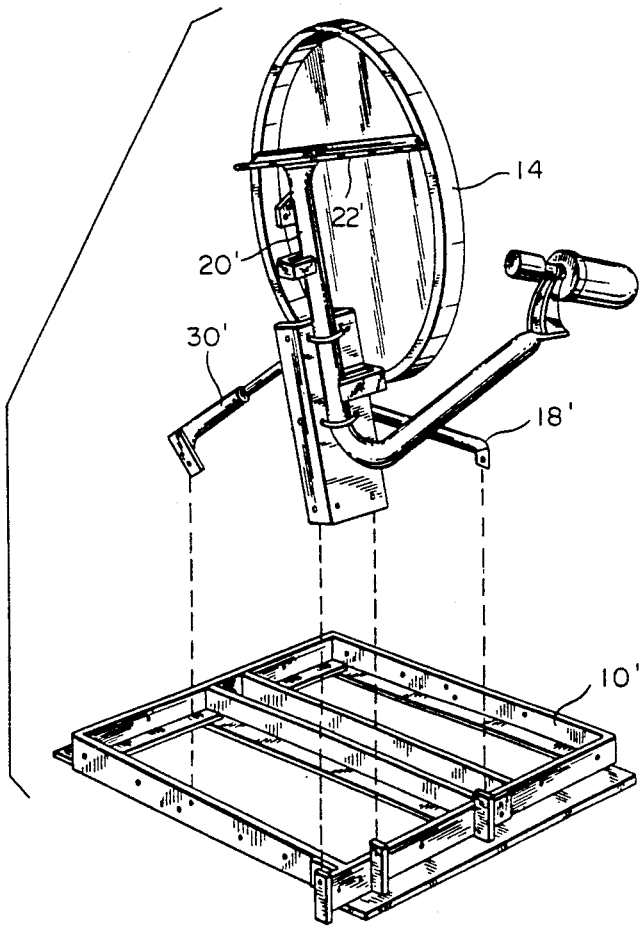
FIG. 4 is a view similar to FIG. 2 illustrating a second embodiment of the invention.
Figure 6A:
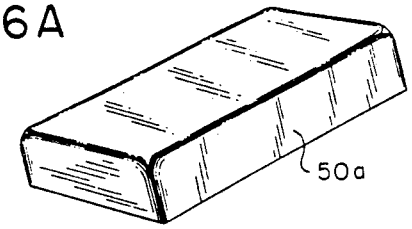
FIGS. 6A through 6E inclusive depict various ballast covers that can be employed in any of the embodiments of the invention.
Figure 6B:
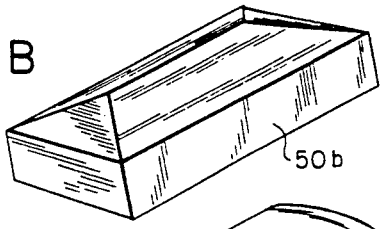
Figure 6C:
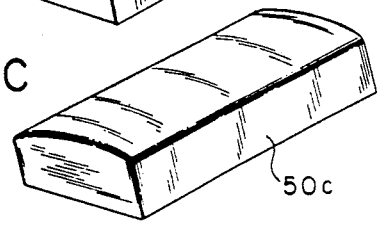
Figure 6D:
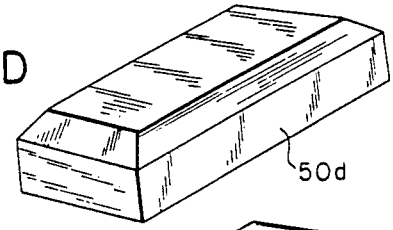
Figure 6E:
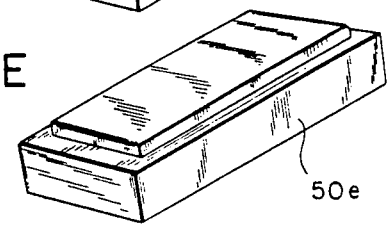

The two section tray 10' is further illustrated in FIG. 4 which, in addition, depicts other possible variations of the invention More particularly, antenna back support 20' can have its upper end attached to a cross bar 22' whose position is different from that of cross bar 22 shown in FIG. 2, actuator 30' need not be associated with a coarse adjustment member 33 as in FIG. 2, the actuator can be pivotally attached to an intermediate portion of one of the side walls of tray 10' rather than near one of the corners of the tray, and brace 18' can similarly be pivotally attached to an intermediate portion of one of the sides of tray 10' rather than at a corner of the tray. The overall arrangement shown in FIG. 4 is otherwise the same as that previously described in reference to FIG. 2, and is utilized in the same way.

Figure 5:
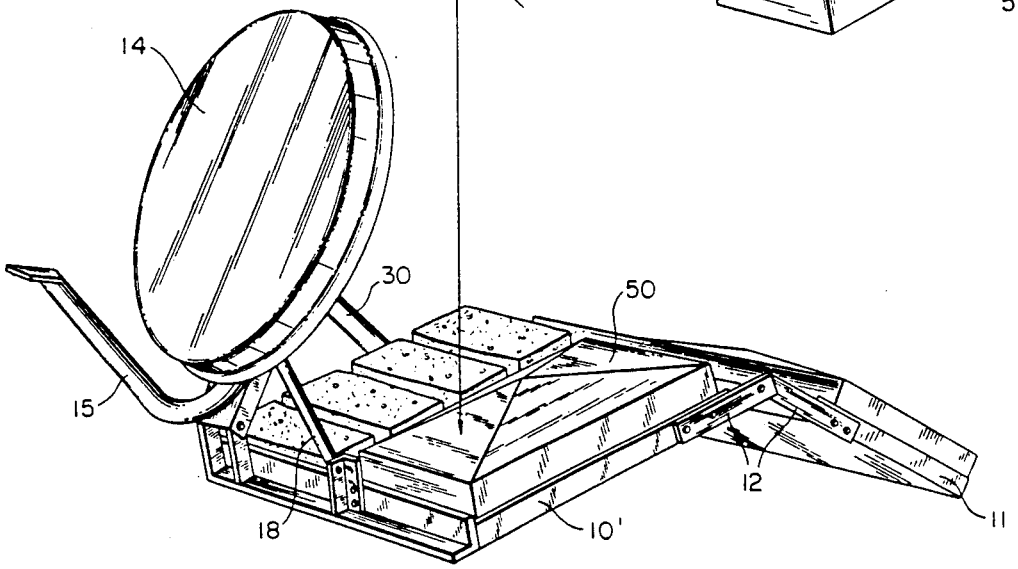
FIG. 5 is a view similar to FIG. 1 illustrating still another embodiment of the invention.

Inasmuch as the antenna assembly is mounted on a ballast tray that is placed on a rearward portion of an inclined pitched roof, and inasmuch as the portion of that rear ballast tray closest to the crown of the roof is spaced from and below the crown of the roof (as shown for example in FIGS. 3 and 7) the antenna reflector and feed structure is at least partially concealed from view from the front of the roof, and is visible in its entirety only from the rear of a residence. This is highly desirable from an aesthetic point of view. The ballast on each tray is, moreover, covered and concealed by caps, tanks or containers which simulate skylights to further improve the aesthetics of the entire assembly. A typical such cap, tank or container is shown at 50 in FIG. 5. Other possible configurations of the ballast caps, tanks or containers are illustrated at 50*a*–50*e* in FIGS. 6A–6E respectively. Typically, when employed in conjunction with concrete block ballast, each ballast cover is a cap fabricated of a plastic material and sized to cover one complete row of ballast, one such cap being provided to conceal each row of concrete ballast on both the forward and rearward trays of the nonpenetrating roof mount. When employed in conjunction with liquid or granular ballast, each skylight simulating cover is a closed tank or container fabricated of a plastic material or metal to hold the ballast therein.

While I have thus described preferred embodiments of the present invention, variations will be readily apparent to those skilled in the art. It must therefore be understood that the foregoing description is intended to be illustrative only and not limitative of the present invention, and all such variations and modifications as are in accord with the principles described are meant to fall within the scope of the appended claims.

Having thus described my invention I claim:

1. An antenna assembly comprising a satellite antenna and a nonpenetrating roof mount therefor, said assembly including a four-sided rectangular ballast tray adapted to receive and support ballast, an antenna reflector having a rear side and a forward side, an elongated flat-sided channel, means pivotally connecting one end of said elongated channel to one of the four corners of said rectangular tray, an L-shaped unitary support member having a pair of legs, at least one of said legs being tubular in configuration, U-bolt clamping means for connecting said one of said legs to a flat side of said channel to permit said one of said legs to be rotatably adjusted about a central axis of said tubular leg and then to be locked in position relative to said channel, means connecting said one of said legs to said rear side of said antenna reflector whereby said rotatable adjustment of said one of said legs effects polar adjustment of said antenna reflector, an antenna feed structure connected to the other of said legs in spaced facing relation to the forward side of said antenna reflector, an actuator rod extending between said elongated channel and one of the sides of said ballast tray in spaced relation to said one corner of said rectangular tray, said actuator rod being adjustable in length to permit adjustment of the angle of said elongated channel relative to said ballast tray about its said pivotal connection thereby to adjust the azimuth of said antenna reflector and feed structure, and an elongated brace having one end connected to said channel and a second end pivotally connected to another of the sides of said ballast tray in spaced relation to said one corner of said rectangular tray.

2. The antenna assembly of claim 1 including a cover structure on said ballast tray which conceals ballast supported by said tray, said cover structure being configured to simulate a skylight.

3. The antenna assembly of claim 2 wherein said cover structure is a closed container which contains ballast therein.

4. The antenna assembly of claim 3 wherein said ballast is a liquid material.

5. The antenna assembly of claim 3 wherein said ballast is a granular material.

6. The antenna assembly of claim 2 wherein the sides of said rectangular ballast tray include mounting means adapted to permit said one end of said elongated channel to be pivotally connected to any one of the four corners of said rectangular tray.

7. The antenna assembly of claim 1 wherein the sides of said rectangular ballast tray include mounting means adapted to permit said one end of said elongated channel to be pivotally connected to any one of the four corners of said rectangular tray.

8. The antenna assembly of claim 1 wherein said nonpenetrating roof mount is adapted to be placed over the crown of a pitched roof, said roof mount including a further rectangular ballast tray, means hingedly connecting said further ballast tray to said first-mentioned ballast tray, said hinged connection being adapted to be located at the crown of the roof, said further ballast tray being adapted to overlie an inclined portion of the roof forward of the crown, and said first-mentioned ballast tray being adapted to overlie an inclined portion of the roof rearward of the crown whereby the pitch of the roof at least partially conceals said antenna reflector and feed structure from view from the front of the roof, and cover structures on each of said ballast trays which conceal ballast supported by said trays, each of said cover structures being configured to simulate a skylight.

9. The antenna assembly of claim 8 wherein said means for hingedly connecting said ballast trays to one another include elongated links that space the portions of said trays closest to the crown of the roof from the crown of the roof.

10. An antenna assembly having a nonpenetrating roof mount for mounting a satellite antenna on a pitched roof, comprising first and second ballast trays adapted to be placed respectively on inclined portions of a pitched roof forward and rearward of the crown of the roof, hinge means extending between said first and second trays for hingedly interconnecting said first and second ballast trays to one another, said hinge means including elongated links extending in directions transverse to the crown of the roof for spacing the portions of said ballast trays that are closest to the crown of the roof from the crown of the roof, each of said ballast trays comprising a rectangular metallic frame of comparatively low height adapted to receive and support ballast and adapted to assume an inclined orientation that corresponds to the incline of the roof portion upon which said ballast tray is placed, a cover structure on each of said ballast trays for concealing ballast supported on said tray, said cover structures being configured to simulate a skylight, and means for mounting a satellite antenna below the crown of the roof at one of the four corners of the rectangular frame of the one of said ballast trays that is located rearward of the crown of the roof, whereby said satellite antenna will be at least partially concealed from view by the spacing of said antenna from the crown of the roof and by the inclination of the portion of the pitched roof upon which said antenna is mounted.

11. The antenna assembly of claim 10 wherein the rectangular frame of the ballast tray located rearward of the crown of the roof includes means for interchangeably mounting the satellite antenna at any one of the four corners of said frame.

12. The antenna assembly of claim 10 wherein said first and second ballast trays are of different size.

13. The antenna assembly of claim 10 wherein the metallic frame of at least one of said ballast trays defines at least one rectangular ballast frame section that is elongated in a direction parallel to the crown of the roof, the skylight simulating cover structure on said ballast frame section being similarly elongated.

14. The antenna assembly of claim 10 wherein the metallic frame of at least one of said ballast trays defines at least one rectangular ballast frame section that is elongated in a direction transverse to the crown of the roof, the skylight simulating cover structure on said ballast frame section being similarly elongated.

15. The antenna assembly of claim 10 including adjusting means, supported by the frame of the ballast tray upon which said satellite antenna is mounted, for varying the elevation and polar orientation of said antenna, the skylight simulating cover structure on the ballast tray upon which said satellite antenna is mounted having a height relative to the extent to which the elevation of said antenna may be varied by said adjusting means, which assures that, at its maximum elevation, the satellite antenna will not engage said cover structure.

16. The antenna assembly of claim 10 wherein said cover structures are closed tanks for liquid ballast.

17. The antenna assembly of claim 10 wherein said cover structures are closed containers for granular ballast.

18. The antenna assembly of claim 10 wherein said cover structures removably overlie concrete block ballast.

* * * * *